US007565770B2

(12) United States Patent
Delgado et al.

(10) Patent No.: US 7,565,770 B2
(45) **Date of Patent: *Jul. 28, 2009**

(54) RESET MECHANISM FOR A PANEL GUIDE AND IMPACT SEPARATION SYSTEM FOR A SLIDING DOOR

(75) Inventors: Joe M. Delgado, West Bend, WI (US); Louis B. Mueller, Richfield, WI (US)

(73) Assignee: Rytec Corporation, Jackson, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/754,533

(22) Filed: May 29, 2007

(65) Prior Publication Data

US 2007/0234641 A1 Oct. 11, 2007

Related U.S. Application Data

(63) Continuation of application No. 10/922,786, filed on Aug. 19, 2004, now Pat. No. 7,222,457, which is a continuation-in-part of application No. 10/320,323, filed on Dec. 16, 2002, now Pat. No. 7,117,637.

(60) Provisional application No. 60/341,408, filed on Dec. 14, 2001.

(51) Int. Cl.
*E05B 65/10* (2006.01)

(52) U.S. Cl. ..... 49/141; 49/360

(58) Field of Classification Search ..... 49/141, 49/360; 105/348; 16/87.4 R, 87.6 R, 94 R, 16/102, 101, 96 R, 106, 91, 96 D
See application file for complete search history.

(56) References Cited

U.S. PATENT DOCUMENTS 1,205,707 A 11/1916 Cahill
1,960,660 A 5/1934 Alion (Continued)

FOREIGN PATENT DOCUMENTS

DE 274 56 11 4/1979

(Continued)

OTHER PUBLICATIONS

Wright, Carroll., "Cold Storage Doors," The Construction Specifier v 48 n 4, Apr. 1995, 5 pages.

(Continued)

*Primary Examiner*—Jerry Redman
(74) *Attorney, Agent, or Firm*—Factor & Lake, Ltd.

(57) ABSTRACT

A sliding door for selectively opening and closing an opening is disclosed. The door is comprised of a door panel having a top, a bottom, a leading edge and a trailing edge. The door panel translates laterally relative to the opening between a closed position and an open position. The door has a guide, a guide follower, and a reset member. The guide is mounted to a mounting surface located between the upper and lower extent of the opening, and comprises a first end disposed proximate the opening and a second end opposite the first end. The guide follower is attached to the door panel and disposed in operable engagement with the guide. The reset member is disposed proximate the second end of the guide. The reset member has a surface that is angularly oriented to facilitate operable engagement and alignment of the guide follower with the guide.

14 Claims, 10 Drawing Sheets

U.S. PATENT DOCUMENTS

| | | | | |
|---|---|---|---|---|
| 2,373,023 | A | | 4/1945 | Goodwin |
| 2,425,016 | A | | 8/1947 | Weaver |
| 2,658,571 | A | | 11/1953 | Guth et al. |
| 2,912,236 | A | | 11/1959 | Hallstrom, Jr. |
| 3,197,817 | A | | 8/1965 | Voris |
| 3,348,337 | A | | 10/1967 | Grasso |
| 3,802,450 | A | | 4/1974 | Forcina |
| 3,802,480 | A | | 4/1974 | Daggy |
| 3,810,656 | A | | 5/1974 | Fox et al. |
| 3,834,081 | A | | 9/1974 | Catlett |
| 4,030,246 | A | | 6/1977 | Naylor |
| 4,058,191 | A | | 11/1977 | Balbo |
| 4,134,178 | A | | 1/1979 | Stevens |
| 4,427,049 | A | | 1/1984 | Belanger et al. |
| 4,619,075 | A | | 10/1986 | Wiles |
| 4,646,471 | A | | 3/1987 | Shaiu |
| 4,800,946 | A | | 1/1989 | Rosenoy |
| 4,882,876 | A | | 11/1989 | Daugirdas |
| 4,887,659 | A | | 12/1989 | West |
| 4,961,454 | A | | 10/1990 | Reilly, Jr. et al. |
| 5,025,846 | A | | 6/1991 | West |
| 5,143,137 | A | | 9/1992 | West |
| 5,295,527 | A | | 3/1994 | West |
| 5,301,468 | A | | 4/1994 | Kamezaki |
| 5,305,855 | A | | 4/1994 | Rivera et al. |
| 5,469,661 | A | | 11/1995 | Finkelstein et al. |
| 5,542,738 | A | | 8/1996 | Walker et al. |
| 5,573,298 | A | | 11/1996 | Walker et al. |
| 5,598,606 | A | | 2/1997 | Jacobs |
| 5,638,883 | A | | 6/1997 | Schulte |
| 5,742,979 | A | | 4/1998 | Garcia-Hernando |
| 5,887,385 | A | | 3/1999 | Horner et al. |
| 5,907,890 | A | | 6/1999 | Redaelli |
| 5,915,448 | A | | 6/1999 | Schulte |
| 5,957,187 | A | | 9/1999 | Schwingle |
| 5,967,595 | A | * | 10/1999 | Heya et al. ..... 296/155 |
| 6,089,305 | A | | 7/2000 | Gruben et al. |
| 6,095,229 | A | | 8/2000 | Kellogg et al. |
| 6,330,763 | B1 | | 12/2001 | Kern et al. |
| 6,336,248 | B1 | | 1/2002 | Finkelstein et al. |
| 6,615,898 | B2 | * | 9/2003 | Schulte ..... 160/201 |

FOREIGN PATENT DOCUMENTS

| | | | |
|---|---|---|---|
| DE | 298 08 179 | U1 | 7/1998 |
| EP | 0 551 961 | A1 | 7/1993 |
| EP | 0 586 646 | B1 | 3/1994 |
| EP | 0953708 | | 11/1999 |
| FR | 2191010 | | 6/1972 |
| FR | 2582343 | | 5/1985 |
| FR | 2631072 | | 11/1989 |
| GB | 1410461 | | 10/1975 |
| JP | 06032572 | A | 2/1994 |
| WO | WO 95/19485 | | 7/1995 |
| WO | WO 01 18469 | A1 | 3/2001 |
| WO | WO 03/052226 | A2 | 6/2003 |
| WO | WO 03/052226 | A3 | 6/2003 |

OTHER PUBLICATIONS

Ullner, F., "New Generation of Cold Store Sliding Doors in the GDR," Luft Kaeltetech v 23 n 1 1987, pp. 42-45. (German).

Saino, Joseph Neuhoff, "Industrial Doors: The Types and Uses," The Construction Specifier v 41 n 3 Mar. 1988, pp. 76-77, 79-81.

Macpherson, Allan, "Falling In fire doors," Fire Prev n 251 Jul.-Aug. 1992, pp. 25-28.

Product Catalog, "Jamison Sound Reduction Special Purpose Cold Storage Doors," 08300/JAM—BuyLine 0537, Jamison Door Company 1988, 8 pages.

Product Literature, Therm-L-Tee Systems Inc., 5 pages.

Kason 8200 Space$aver™ Sliding Doorware® "What a Difference Doorware® Can Make to a Foodservice Bottom Line," © 2001, 6 pages.

Product Catalog, "Thermo Isolierende Tursysteme" Preisliste 1996, Manifactture Tecnolegno Hartz, 32 pages (including from and back covers).

German Article entitled Thermo-Insulating Door Systems with English translation, by Manifatture Technolegno Hartz s.r.l., 1996, English articles contains 14 pages along with German article consisting of 19 pages.

* cited by examiner

FIG. 4
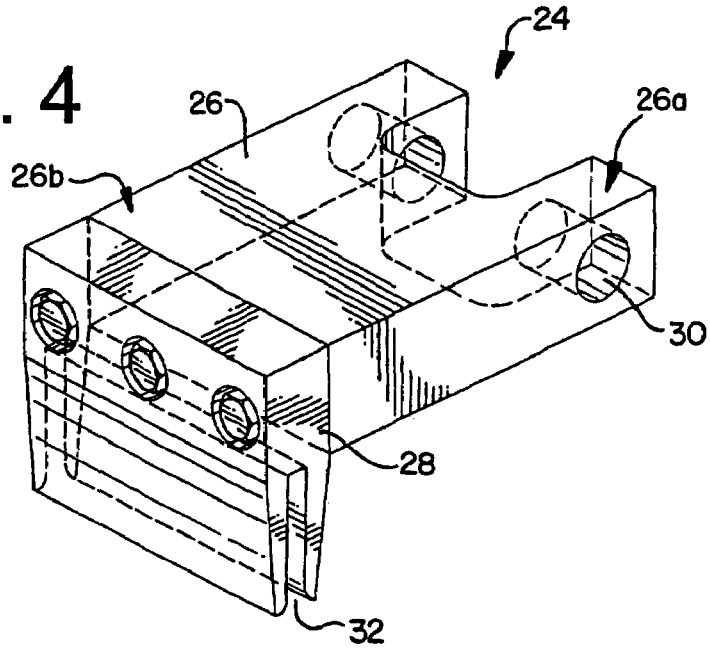
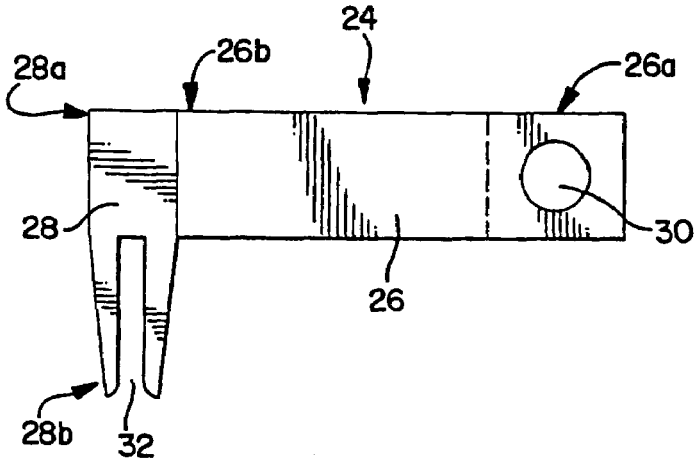
FIG. 5
FIG. 6
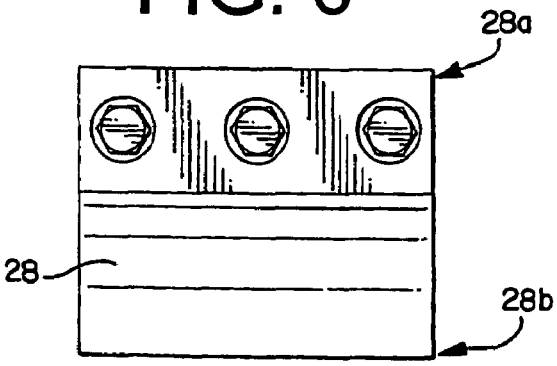
FIG. 7
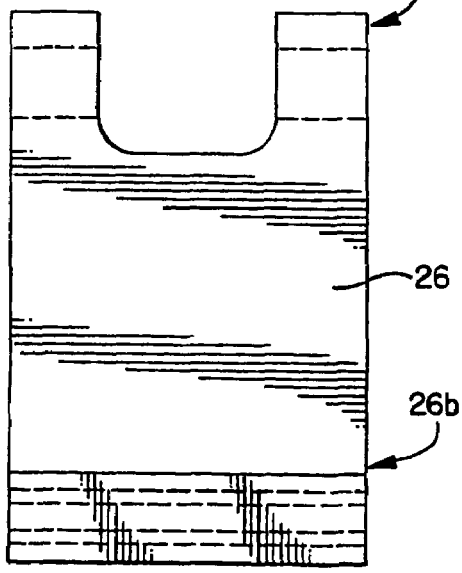

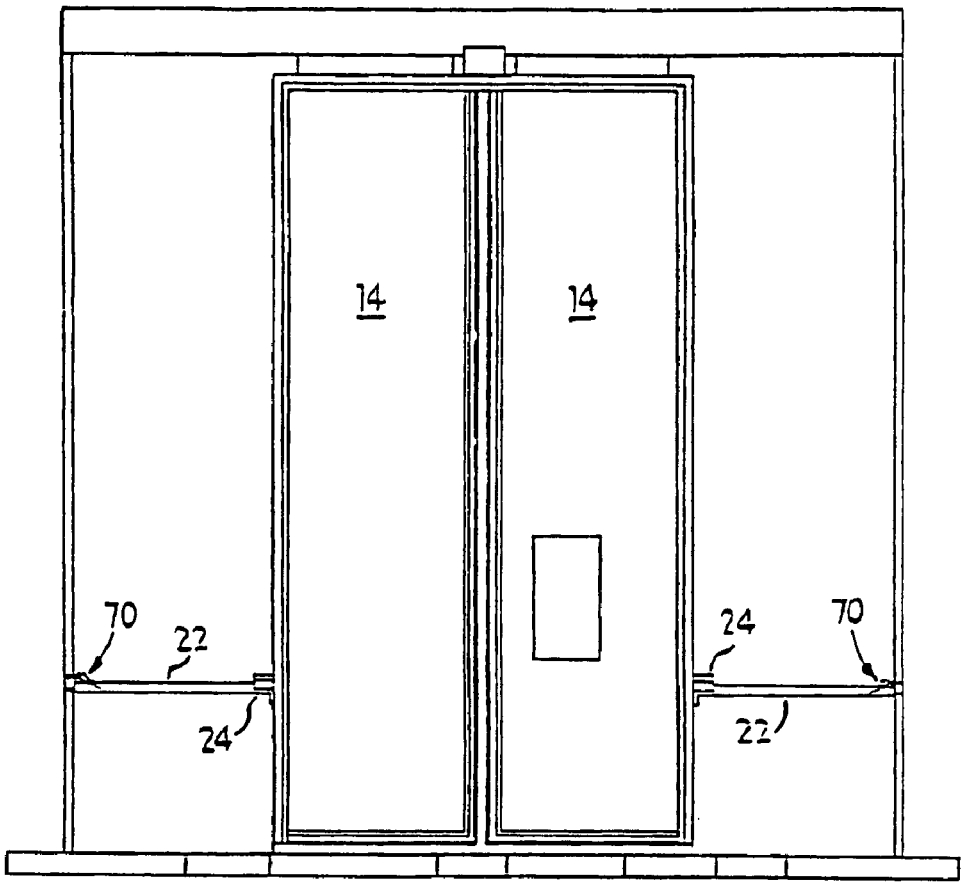
Fig 15
Fig 16
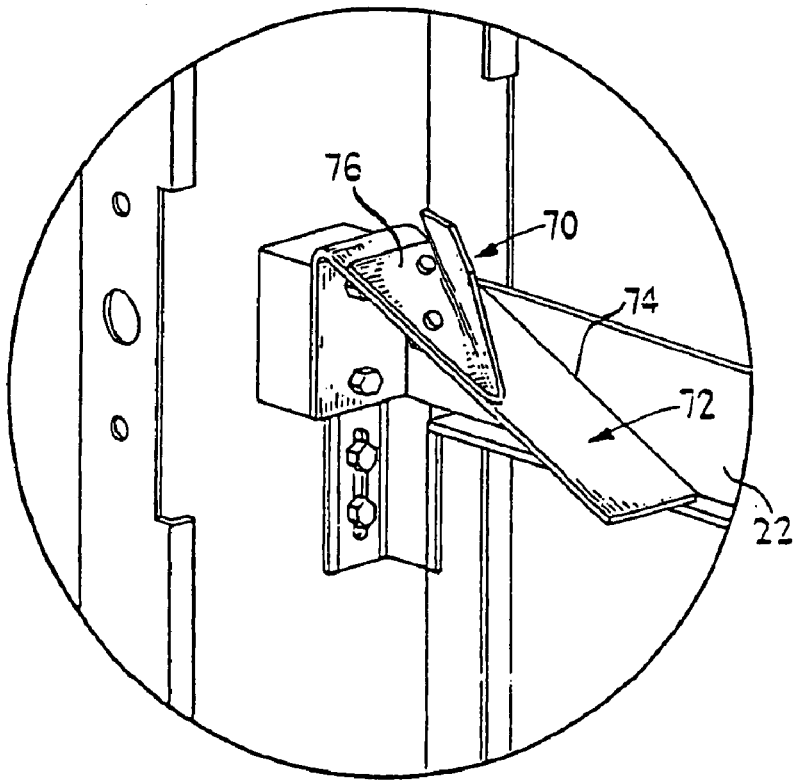

RESET MECHANISM FOR A PANEL GUIDE AND IMPACT SEPARATION SYSTEM FOR A SLIDING DOOR

RELATED APPLICATIONS

This is a continuation application of U.S. Ser. No. 10/922,786 now U.S. Pat. No. 7.222,457 filed Aug. 19, 2004, which is a continuation-in-part of U.S. Pat. Ser. No. 10/320,323 now U.S. Pat. No. 7,117,637 filed Dec. 16, 2002, which claims the benefit of U.S. Provisional Application Ser. No. 60/341,408, filed Dec. 14, 2001. This application is also related to abandoned U.S. patent application Ser. No. 11/451,135, filed Jun. 12, 2006.

TECHNICAL FIELD

The invention relates to a panel guide and impact separation system for a sliding door, and more particularly to a mechanism for resetting the panel guide after an impact on the sliding door occurs.

BACKGROUND OF THE INVENTION

Sliding doors have been used for many years to secure or isolate various enclosures, including those for cold storage facilities, manufacturing plants, warehouses, garages, and other industrial rooms. Unique to cold storage applications is the need for both door speed and sealing of the doors when closed. Also, unique to cold storage applications is the need for good insulating properties of the door panels themselves. To accommodate both the desirability of fast opening and closing, as well as good insulating properties, door panels can be constructed, for example from light-weight foam.

Inherent to doors used in connection with cold-storage applications are problems associated with air pressure differentials across opposite faces of the door. These differentials can be caused by a large temperature differential between the cold storage area and the area outside of the cold storage area. These pressure differentials, and others caused for example, by ambient wind, tend to push the door panels inward or outward and away from the walls surrounding the door. Air pressure differentials can also be created by a rapidly actuated panel. Any of these causes can displace a door panel out of its intended plane of travel. This is especially true for relatively light weight panels. This displacement can result in improper positioning of the door when it reaches its closed position, thereby creating problems with proper sealing of the doorway. This can also result in wear and ultimately damage to the hardware associated with the door, including the overhead track.

Others have proposed devices for helping to keep a sliding door panel in proper alignment as it slides. For example, U.S. Pat. No. 6,330,763 issued to Kern et al discloses a ring tethered to a door panel, the ring being slidable along a rope attached to the wall. This rope and ring system is proposed to retain door panels in a position near a wall when sliding. However, it appears that the system proposed in Kern has several deficiencies including that the rope and ring tether (slide restraint and slide) would not, especially with flexible door panels, provide sufficient control over the entire panel except for a portion, such as the trailing edge of the panel, where the slide is tethered to the panel.

Another problem associated with industrial doors is that based upon productivity goals, doors are often hit by forklift trucks or the like which traverse the door opening while the door panels are Still partially or completely in a closed position. Accordingly, systems have been proposed for permitting sliding doors to be displaced from their normal plane of travel to accommodate the impact force of the vehicle. Kern et al discloses making the slide of its system frangible. This would require keeping and inventory of spare parts (e.g. slide rings) and down time for the door and traffic while the slide was replaced by maintenance personnel. Kern also discloses the use of flexible tether or rope. This flexible material adds to the lack of control of the panel. It also appears inherent to such flexible ropes that they would work only for a finite distance of displacement upon impact.

The present invention is provided to solve the problems discussed above and other problems, and to provide advantages and aspects not provided by prior doors of this type.

SUMMARY OF THE INVENTION

According to one aspect of the present invention, a sliding door panel guide and impact separation system for a sliding door is provided. The door is of the type that is adapted to open and close an opening having an upper and lower extent.

According to another aspect of the invention a mechanism is provided to automatically reset the panel guide follower after an impact. The guide is mounted to a mounting surface located vertically between the upper and lower extent of the opening, and comprises a first end disposed proximate the opening and a second end opposite the first end of the guide. The guide follower is attached to the door panel, and is disposed in operable engagement with the guide. The reset member is disposed proximate the second end of the guide.

According to one aspect of the invention, the reset mechanism has a surface that is angularly oriented to facilitate re-engagement and alignment of the guide follower with the guide after they have become disengaged.

According to another aspect of the present invention, the reset member comprises a first ramp and a second ramp. The first ramp is canted upwardly from the plane of travel of the guide follower. The second ramp angularly and upwardly depends from the top surface of the first ramp bad at least partially bisects a top surface of the first ramp.

According to yet another aspect of the present invention, the guide follower is comprised of a retention block and a retention tab, The retention block has a first and second end. A throughway is disposed proximate the first end and provides a pivot point for pivotable connection of the guide follower to a door panel. The retention tab has a first end and a second end. The first end of the retention tab is connected proximate the second end of the retention block. The second end of the retention tab extends generally perpendicular to the retention block and has a channel formed therein proximate a distal end. The channel engages the guide and allows for translation of the guide follower there along.

These and other objects and advantages will be made apparent from the following description of the drawings and detailed description of the invention.

BRIEF DESCRIPTION OF THE DRAWINGS

FIG. 4 is a perspective view of a guide follower according to the present invention;

FIG. 5 is a side view of the guide follower shown in FIG. 4;

FIG. 6 is an end view of the guide follower shown in FIG. 4;

FIG. 7 is a top view of the guide follower shown in FIG. 4;

FIG. 15 is a front view of an industrial door system wherein the reset mechanism for panel guide and impact separation system of the present invention is incorporated;

FIG. 16 is a perspective view of the reset member according to the present invention and shown in FIG. 15;

DETAILED DESCRIPTION

Figure 1:
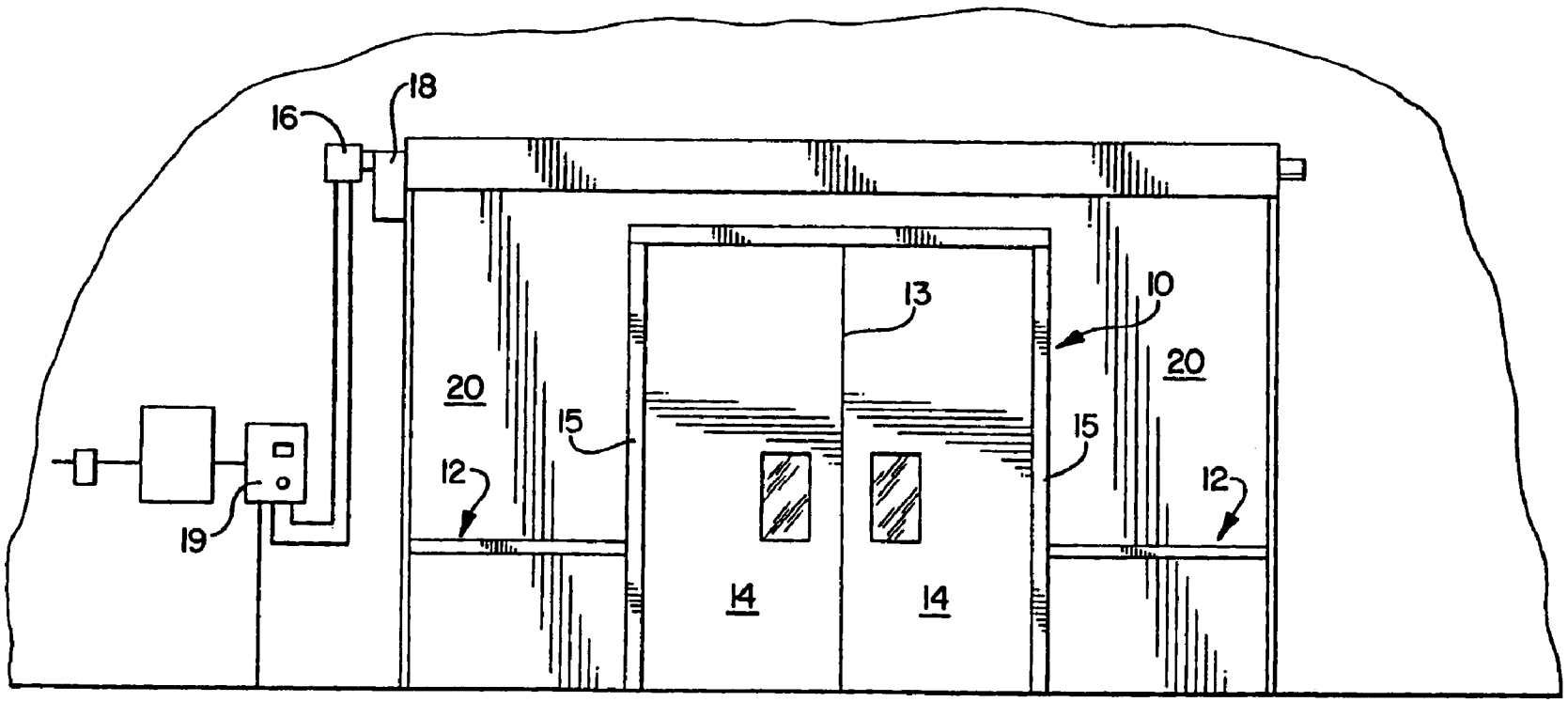
FIG. 1 is a front view of a sliding door and panel guide and impact separation system according to the present invention.

While this invention is susceptible to embodiment in many different forms, there is shown in the drawings, and will herein be described in detail, preferred embodiments of the invention with the understanding that the present disclosure is to be considered as an exemplification of the principles of the invention and is not intended to limit the broad aspect of the invention to the embodiments illustrated.

The present invention is generally directed to a sliding door 10 which incorporates a panel guide and impact separation system 12 (hereinafter, "the guide system 12"). FIG. 1 shows an automatic bi-parting sliding door 10 incorporating the guide system 12 of the present invention. As shown in FIG. 1 the door 10 is generally installed about an opening. "Opening" generally refers to any passage or throughway defined in a general manner by a upper extent, a lower extent and one or more wall edges or other frame-like structures. It is contemplated that opening with which the present invention is employed be a doorway as typically found in a wall of a building or the like. However, the present door can also be installed in a vestibule, which extends away from a doorway. Such vestibules are typically used in applications where it is necessary to minimize the exposure of an interior space to rapid fluctuations in pressure, temperature or other environmental considerations.

The door 10 with which the guide system 12 is used generally comprises at least one door panel 14. As seen in FIG. 1, each door panel 14 has a leading edge 13 and a trailing edge 15, and is adapted to laterally translate along a plane relative to the opening between an open position and a closed position. According to the present invention, the door panels 14 have a substantially linear opening and closing direction of travel. However, it is contemplated that the travel of the door panels 14 between the open and closed positions may be slightly non-linear to compensate for seals on the leading edge 13 of the door 10 or for other reasons deemed necessary for operation of the door 10.

Door panels 14 used in connection with the present invention may be designed in a variety of sizes and may be constructed from any number of materials. For example, in cold storage applications the door panels 14 may be made from foam or other materials suitable for maintaining cold and heat differentials on opposed sides of the panels. However, it would be readily understood by those of skill, that the present invention is not limited to use with foam door panels. Instead the present invention may be used with any door panel 14 of material suitable for a particular application, including wood, metal and various polymeric materials.

Each door panel 14 should be approximately equal to one-half the width of the opening, and of a height approximately equal to the opening height. With a single sliding door panel design, the door panel 14 is preferably of the same approximate height and width of the opening. However, the use of greater than two door panels 14 is also contemplated, and the modification of the presently disclosed invention to accommodate such design variations would naturally be readily understood by those skilled in the art after studying this disclosure, without requiring undue experimentation. Where certain applications may require, it is contemplated by the present invention that the cumulative size of all door panels 14 in a single application could be significantly less than, or significantly more than the size of the opening.

All remaining discussions will be directed to a single sliding door panel design, but it is understood that such discussion will also be applicable to multi-panel sliding door panels 14 and the particular design variations mentioned. These types of doors are well known in the art and application of the following discussion to such doors will be readily understood by those skilled in the art.

Typically, a motor 16 and a drive system 18 are employed in connection with the doors 10 described herein. Specifically, as shown in FIG. 1, a motor 16 is operably coupled to a drive system 18 for actuating the door panel 14 between the open and closed positions on an overhead track. For example, the present invention may utilize drive motor 16 of the type manufactured by SEW-Eurodrive and marketed under the trade name a SEW-Eurodrive MOVIMIT®. However, doors used in connection with the present system may employ any drive motor 16 that is capable of at least bi-directional, two-speed operation. The door of the present invention may also include a controller 19 that is in electronic communication with the motor 16. The controller 19 may be any type suitable for use with door assemblies, and which are adapted to control the starting, stopping, speed and direction of the motor 16. It is contemplated, however, that the present invention be employed in an application wherein the door panel 14 is manually moved between the opened and closed positions.

The guide system 12 of the present invention provides several advantages over prior art systems. For example, the guide system 12 disclosed herein acts to maintain the actuating door panel 14 in close proximity to the surrounding wall or mounting surface 20 throughout substantially its entire path of travel. Additionally, the guide system 12 is adapted to accommodate and incorporate breakaway features, if so desired. The guide system 12 also provides a point at which forces applied to semi-flexible door panel 14 may be concentrated and thus provides predictability in the distribution of the forces in the door. The guide system 12 and its additional advantages will now be described below in further detail.

As may be seen in FIGS. 1-14, the guide system 12 generally comprises a guide 22 and a guide follower 24. The guide 22 is mounted to a mounting surface 20 located between the upper and lower extent of the opening. As discussed above, the mounting surface 20 may be a wall surrounding a doorway, or a freestanding surface such as that used in connection with a vestibule. The guide 22 may be any surface suitable for accommodating generally linear travel of the door panel 14 between an open and closed position. For example, the guide 22 may be a plate, a rod, a bar, a u-shaped track, a v-shaped track, or a c-shaped track. The present invention, however, should not be limited to the geometric configurations specifically described or shown herein, as any geometric configuration that provides a generally linear guide path of travel for the door panel 14 may be employed without departing from the present invention.

Figure 2:
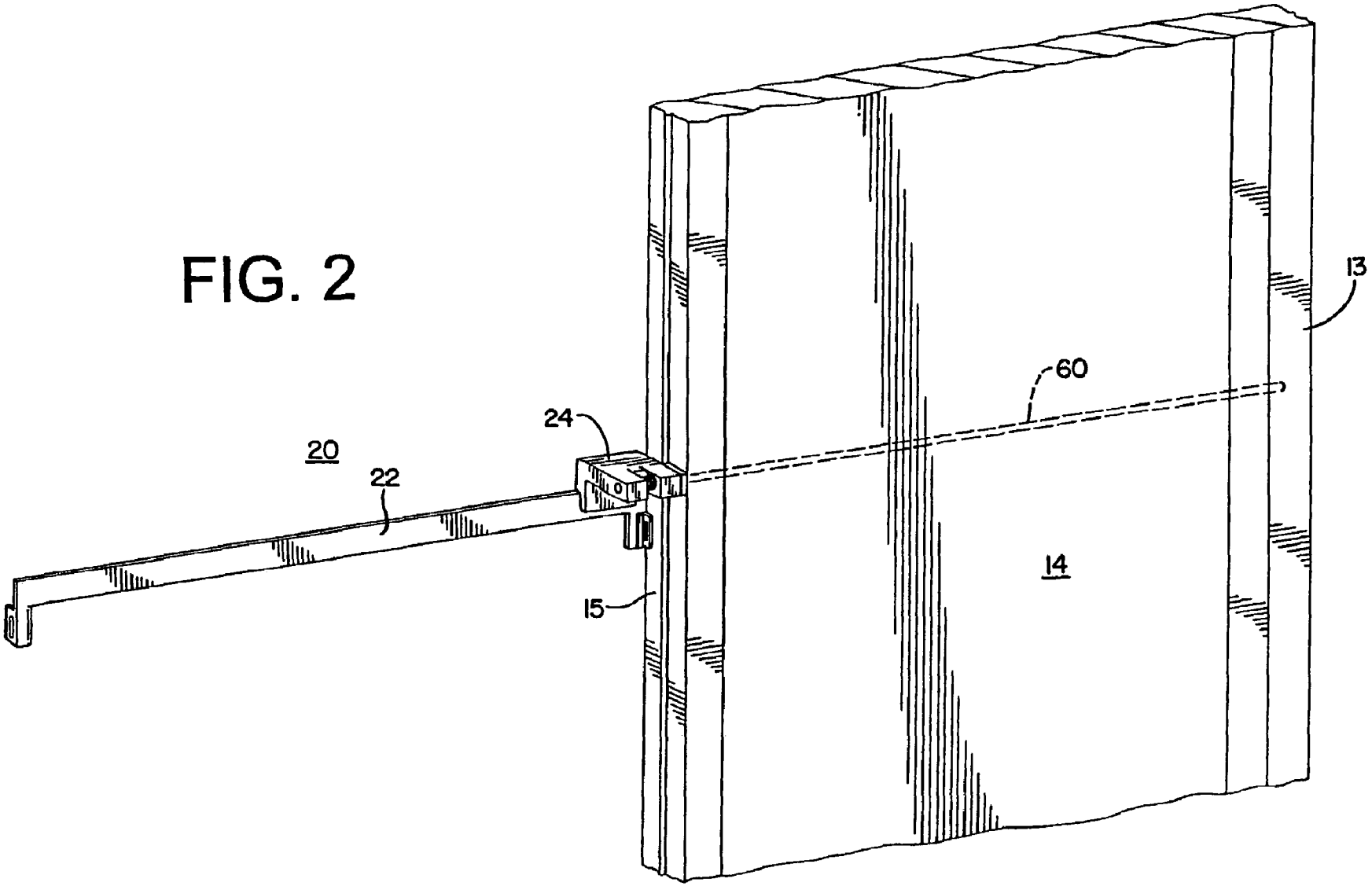
FIG. 2 is partial perspective view of a door and panel guide and impact separation system according to the present invention.
Figure 3:
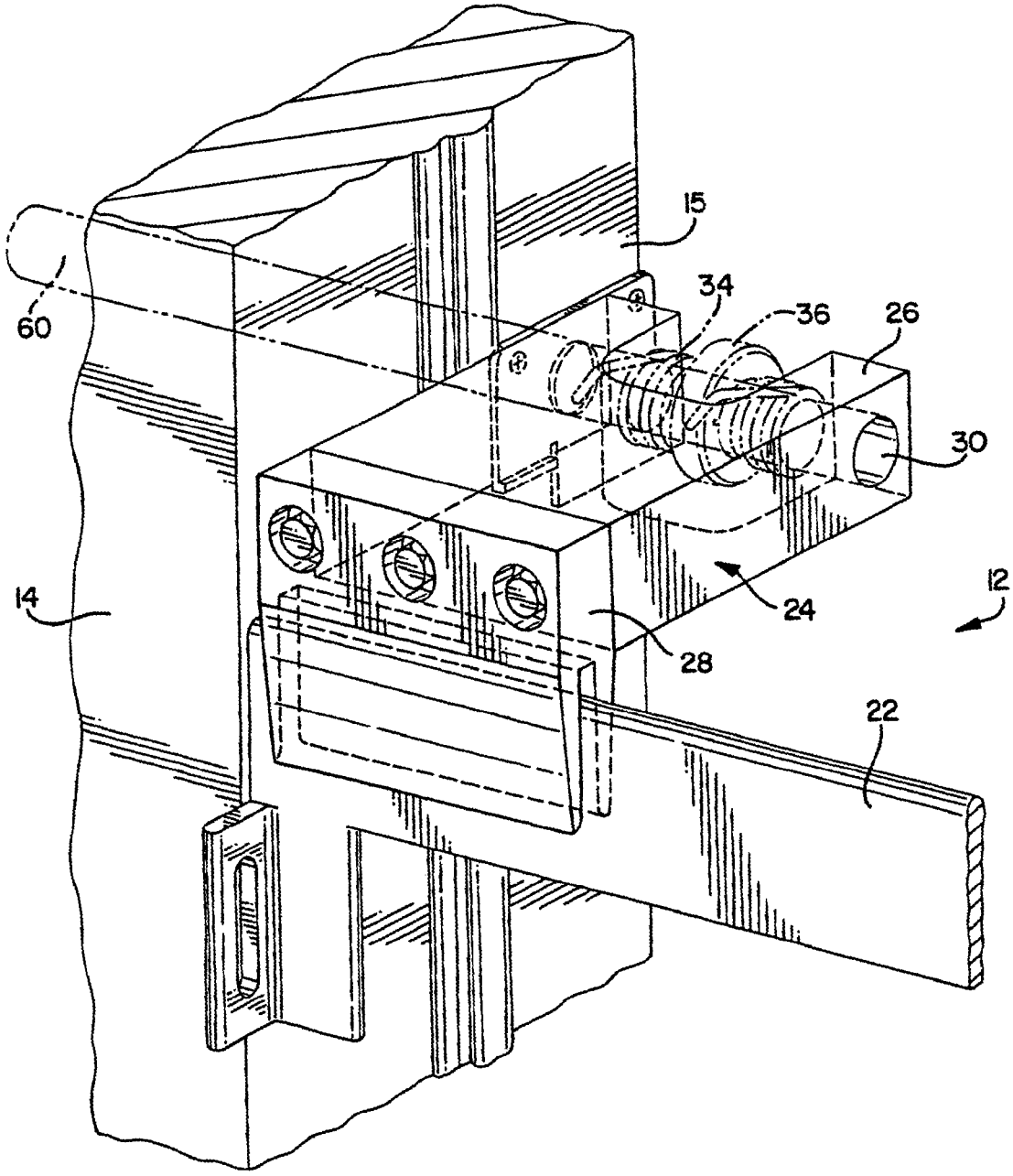
FIG. 3 is partial perspective view of a door and panel guide and impact separation system according to the present invention.

As may be seen in FIGS. 2 and 3, the guide follower 24 is pivotally attached to the door panel 14. The guide follower 24 may be attached to the door panel 14 by any suitable mechanism that allows for pivoting, including a pin or other fastener. The guide follower 24 is disposed in operable engagement with the guide 22 such that, as the door moves between the open and closed positions, the guide follower 24 translates along at least a portion of the guide 22.

According to one embodiment of the present invention shown in FIG. 2-10, the guide follower 24 is comprised of a retention block 26 and a retention tab 28. The retention block 26 has a first end 26*a*, a second end 26*b* and a throughway 30 disposed proximate the first end 26*a*. The throughway 30 provides a pivot point for pivotable connection of the guide follower 24 to the door panel 14. The retention tab 28 has a first end 28*a* and a second end 28*b*. The first end 28*a* of the retention tab 28 is connected proximate the second end 26*b* of the retention block 26. The second end 28*b* of the retention tab 28 extends generally perpendicular to the retention block 26 and has a channel 32 formed proximate its distal end. The channel 32 engages the guide 22 so that there may exist relative sliding between the guide follower 24 and guide 22. Preferably, at least the retention tab 28 is made from a low friction polymeric material to assist sliding engagement of the guide follower 24 and the guide 22.

Figure 8:
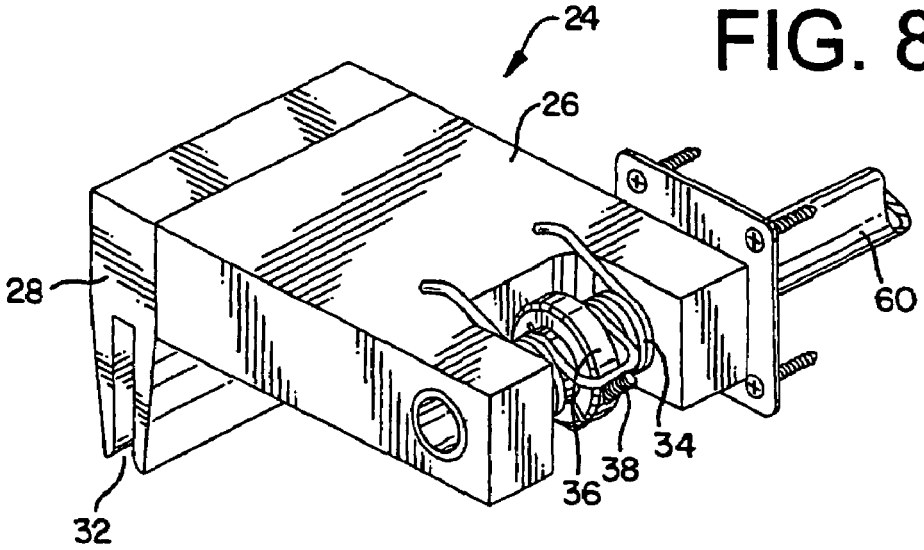
FIG. 8 is a perspective view of a guide follower in connection with a elongate beam according to the present invention.
Figure 9:
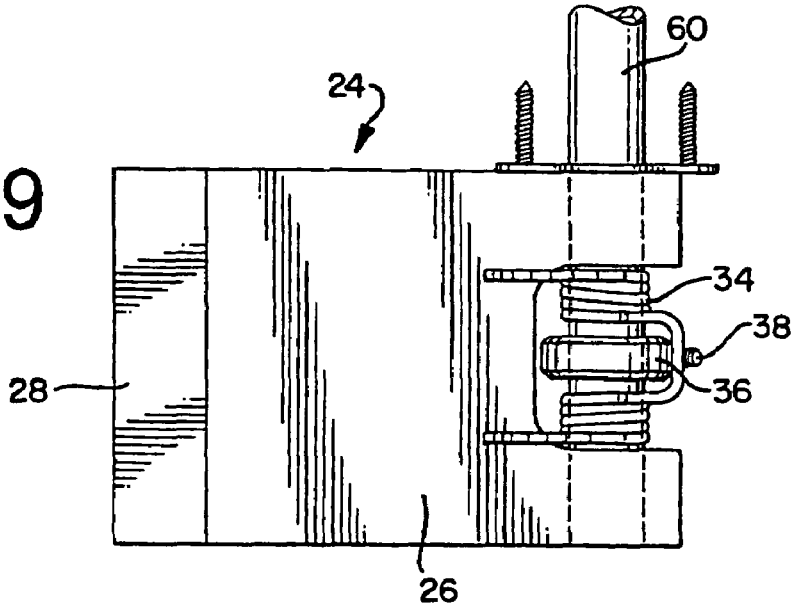
FIG. 9 is a top view of the guide follower and a elongate beam shown in FIG. 8.
Figure 10:
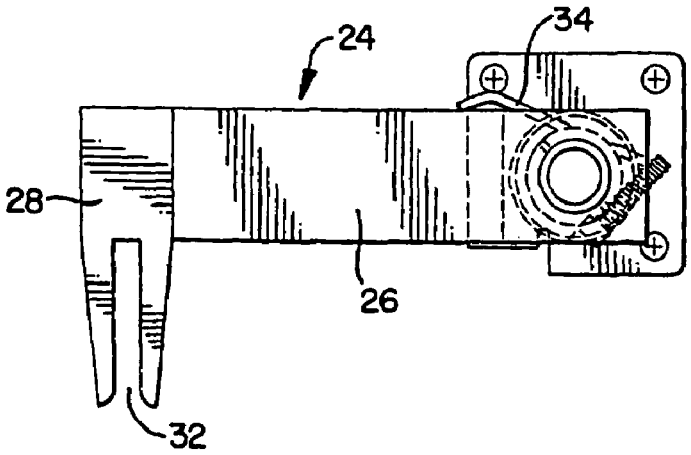
FIG. 10 is a top view of the guide follower and a elongate beam shown in FIG. 8.

The guide follower 24 is pivotally biased around an axis parallel to the lateral translation of the door, thereby forcing the guide follower 24 into operable engagement with the guide 22. This allows for substantially continuous engagement between the guide follower 24 and the guide 22 throughout the entire linear path of travel of the door panel 14. The guide follower 24 can be biased by employing a means for biasing 34. As shown in FIGS. 8-10, the means for biasing 34 is preferably a torsion spring disposed in cooperative engagement with the guide follower 24 and is secured by a clamp 36 and stop mechanism 38. It is contemplated that other biasing mechanisms may be used to bias the guide follower 24, including cams, compression springs, leaf springs, helical springs, elastomeric materials or other suitable biasing mechanisms known to those skilled in the art.

According to the present invention, the guide follower 24 is adapted to disengage the guide 22 when sufficient force is applied to the door panel 14. If the guide follower 24 includes a biasing means 34, such as is described above, the guide follower 24 will disengage the guide 22 when sufficient force is transferred to biasing means 34 to overcome the force that biases the guide follower 24 into engagement with the guide 22. To assist the guide follower 24 in releasing from the guide 22, the guide follower 24 may be made from a semi-flexible polymeric material. According to one embodiment of the present invention, at least the second end 28*b* of the retention tab 28 is sufficiently flexible to permit the guide follower 24 to disengage the guide 22 upon receiving anl impact in excess of a predetermined force. As shown in FIGS. 5 and 10, the second end 28*b* of the retention tab 28 may also be tapered. By tapering the second end 28*b* of the retention tab 28, less material surrounds the channel 32, thus assisting the retention tab 28 in flexing so that guide follower 24 may more easily disengage the guide 22 upon impact to the door panel 14.

Figure 11:
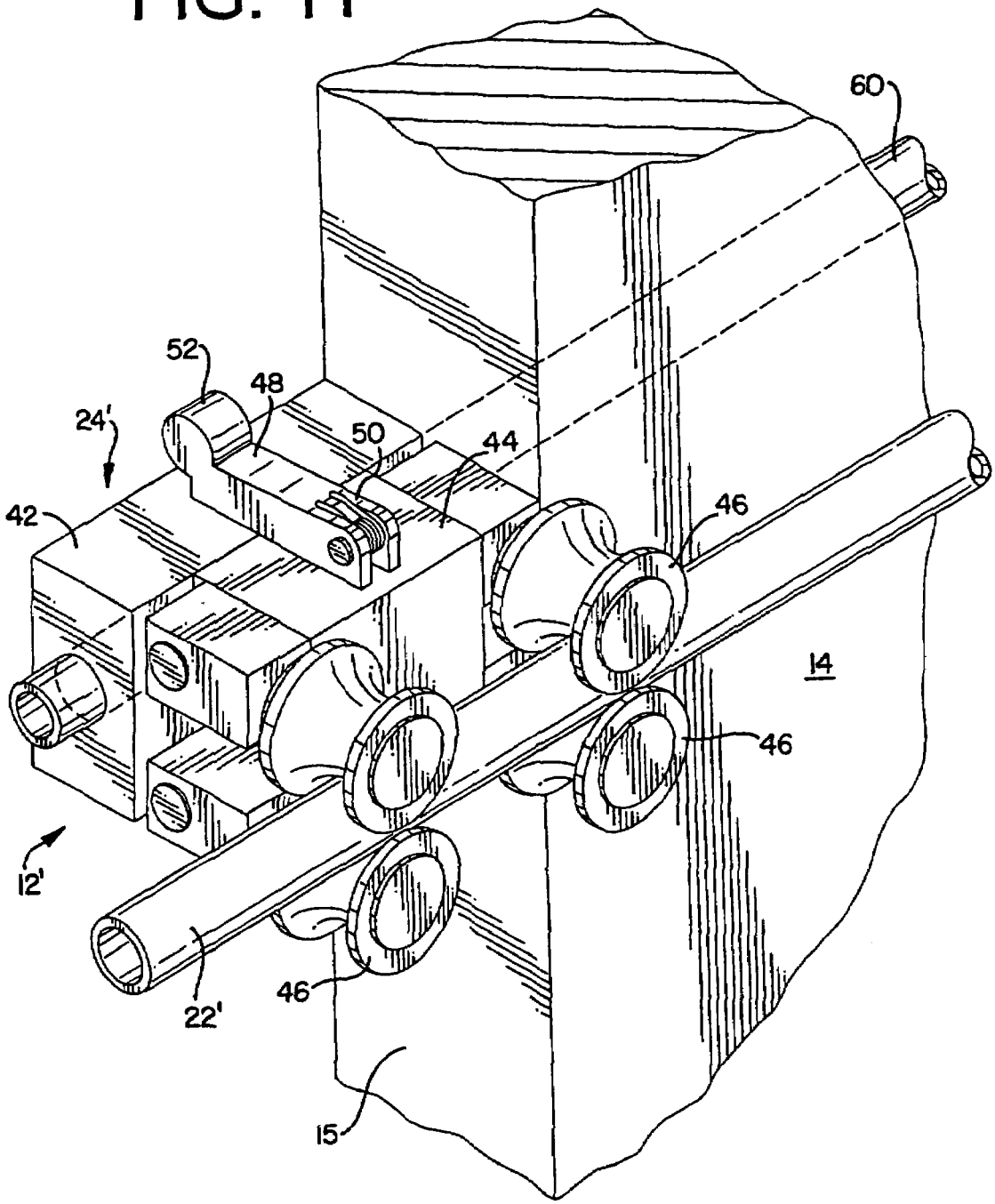
FIG. 11 is partial perspective view of a door and another embodiment of a panel guide and impact separation system according to the present invention.
Figure 12:
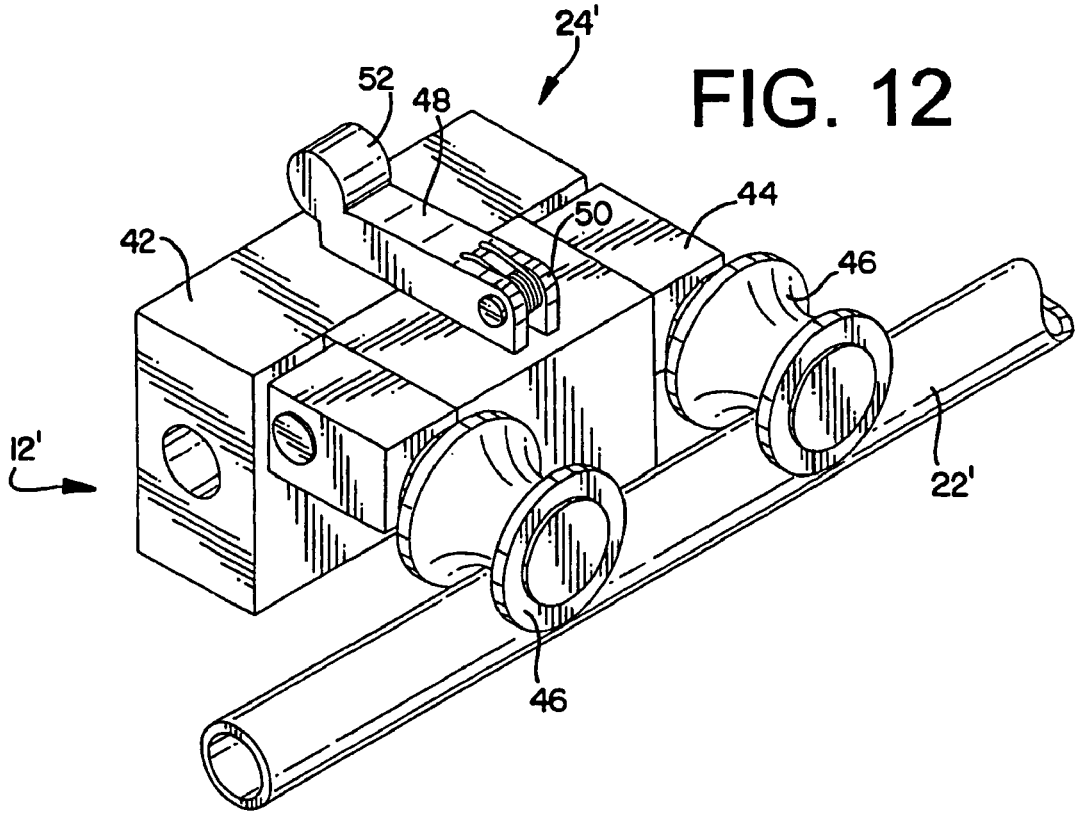
FIG. 12 is partial perspective view of another embodiment of a panel guide and impact separation system according to the present invention.
Figure 13:
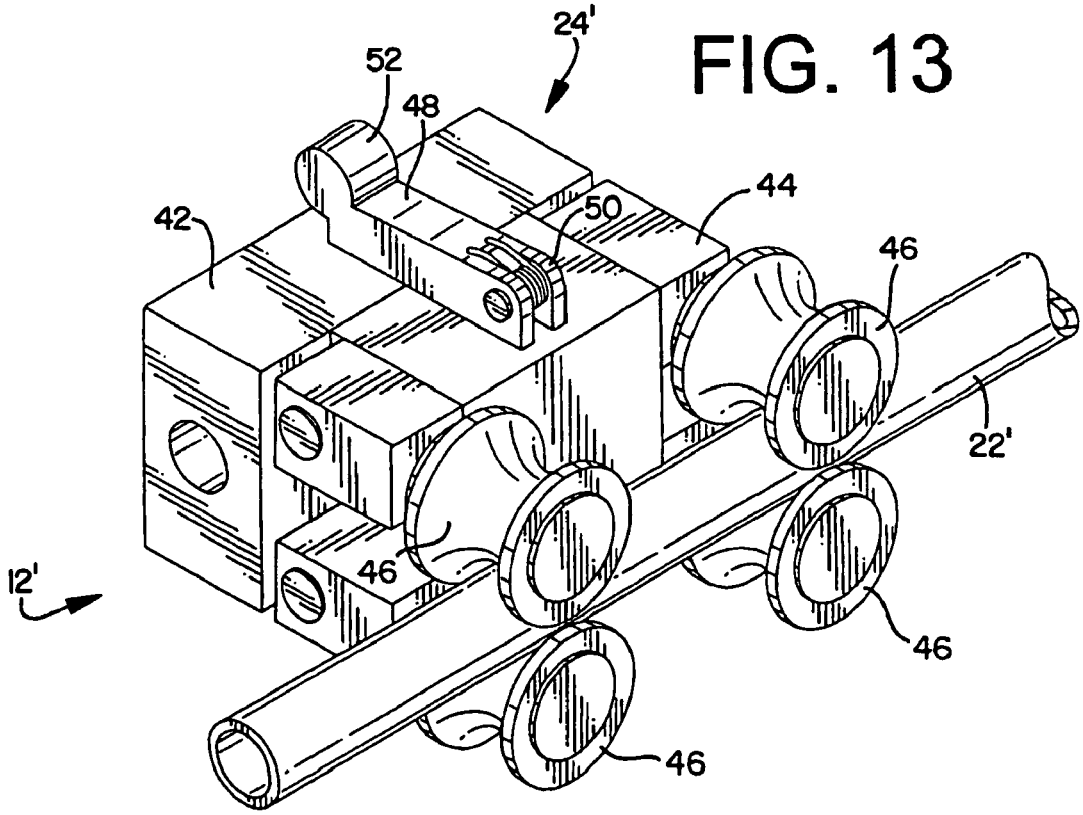
FIG. 13 is partial perspective view of another embodiment of a panel guide and impact separation system according to the present invention.

FIGS. 11-13 illustrate another embodiment of a guide follower 24' that may be used in connection with a guide system 12' of the present invention. As shown in FIGS. 11-13, the guide follower 24' comprises a trolley 40. The trolley 40 generally includes a retention block 42 and a roller assembly block 44. The retention block 42 is attached to the trailing edge 15 of the door and the roller assembly 44 is coupled to the retention block 42. According to the present invention, the roller assembly block 44 has at least one roller 46 operably disposed thereon. In one embodiment shown in FIG. 13, the roller assembly block 44 has a plurality of rollers 46, and at least two of the plurality of rollers 46 engage the guide 22' on opposed sides of the guide 22' so that a channel is formed between the rollers 46. The rollers 46 are preferably made from a low friction polymeric material to assist the guide follower 24' in rolling on the guide 22'.

The guide follower 24' may also include a resilient material (not shown) disposed between the block and roller assembly. In one embodiment, a tensioning arm 48 having a pivoting end 50 and a locking end 52 is attached to either the retention block 42 or the roller assembly block 44. A clasp adapted to receive the locking end 52 of the tensioning arm 48 is attached to the other of the retention block 42 and the roller assembly block 44. According to this configuration, the retention block 42 and roller assembly block 44 may be connected one to the other by the tensioning arm 48. When the locking end 52 of the tensioning arm 48 is fastened to the clasp, the roller assembly block 44 is drawn closer to the retention block 42. The resilient material, however, is of sufficient thickness and resiliency such that when it is compressed, the resilient material creates a resistant force between the retention block 42 and the roller assembly block 44.

The rollers 46 of this embodiment of the guide follower 24' may be press fit on their respective roller mounts such that when a force in excess of a predetermined force is applied to a door panel 14 to which this guide follower 24' is connected, the rollers 46 separate from the trolley 40. Alternatively, the guide follower 24' may be configured such that the rollers 46 remain attached upon application of a predetermined force to the door panel 14, but the retention block 42 separates from the roller assembly block 44.

Figure 14:
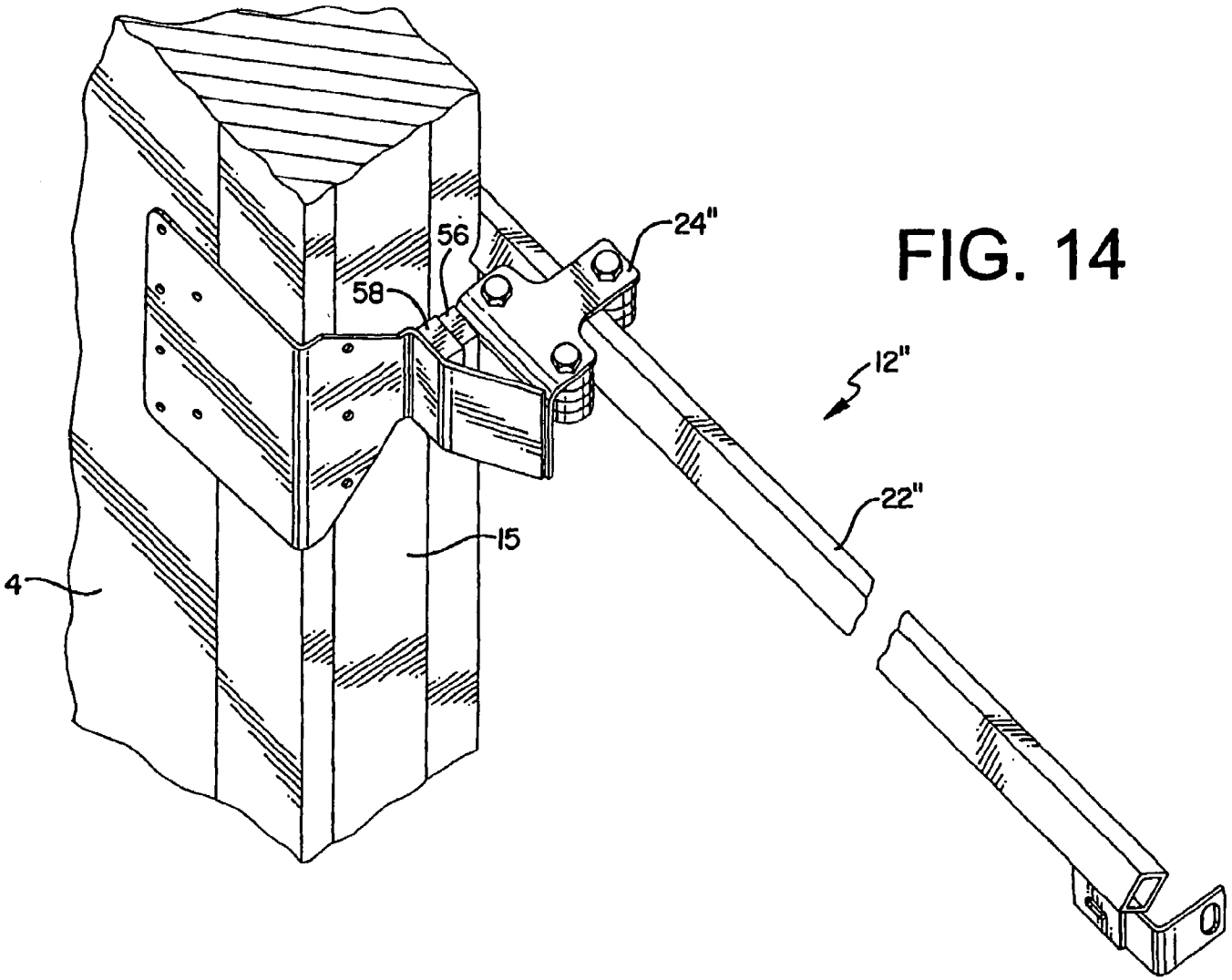
FIG. 14 is partial perspective view of a door and another embodiment of a panel guide and impact separation system according to the present invention.

According to another embodiment of the guide system 12" shown in FIG. 14, a magnet 56 is attached to either the guide follower 24" or the door panel 14. A magnet attracter 58 is attached to the other of the guide follower 24" and the door panel 14. The magnet 56 magnetically engages the attracter 58 and couples the guide follower 24" to the door panel 14. The magnet 56 is separable from the magnet attracter 58 upon an impact to the door panel 14 in excess of a predetermined force, thereby permitting the panel 14 to separate from the guide follower 24".

As shown in FIGS. 2, 3 and 11, the present invention can include an elongate beam 60 which is attached to the door panel 14 between the top and the bottom of the door panel 14. A first portion of the elongate beam 60 extends generally horizontally along a vertical plane of the door panel 14. A second portion of the elongate beam 60 extends away from the leading edge 13 of the door panel 14 and beyond the trailing edge 15 of the door panel 14. Thus, the elongate beam 60 effectively functions as an "outrigger" for the door panel 14. The second portion of the elongate beam 60 operably engages the guide 22, 22', 22". It is contemplated that the second portion of the elongate beam 60 engages the guide 22, 22', 22" directly or, as shown in FIGS. 3 and 11, by attaching one of the above described guide followers 24, 24', 24" proximate the distal second portion of the elongate beam 60. The elongate beam 60 may have any geometric cross-section without departing from the invention, including for example a cylindrical rod or a rectangular beam. Furthermore, it will be apparent to those of skill in the art that the elongate beam 60 may be of any size suitable for the application with which the door 10 is being used.

In one embodiment, the elongate beam 60 extends across substantially the entire vertical plane of the door panel 14. However, it is contemplated by the present invention that the elongate beam 60 extend across less than the entire vertical plane of the door panel 14. The extent to which the elongate beam 60 extends across the door panel 14 will be dictated by the specific application with which the invention is being used, as well as by the size, material and construction of the door panel 14. It will be readily understood by those of skill in the art, however, that any configuration in which some portion of the beam extends across at least a portion of the vertical plane of the panel, and some portion of the elongate beam 60 extends beyond the trailing edge 15 of the door panel 14 will be suitable for the present invention.

According to one embodiment of the present invention shown in FIGS. 2, 3 and 11, the first portion of the elongate beam 60 extends through the core of at least a portion of the door panel 14 and the second portion of the elongate beam 60 extends out of the trailing edge 15 of the door panel 14. For example, in door systems which employ semi-flexible door panels 14 such as those formed of foam, the elongate beam 60 serves to provides stiffness to the door panel 14. Accordingly, the door panel 14 is not only imparted with a degree of stiffness to withstand impact, but the elongate beam 60 also provides improved stiffness to assist in aligning leading edge 13 seals or the like during opening and closing of the door panel 14.

The elongate beam 60, as used in connection with flexible or semi-flexible door panels 14, also provides a point at which impact forces may be concentrated. This provides predictability in the distribution of the forces in the door, thereby allowing a reliable breakaway mechanism. Additionally, the elongate beam 60 acts to ameliorate stress at the connection between the door panel 14 and the guide system 12, 12', 12" by moving the stress point away from the panel edge to the breakaway mechanism associated with the guide system 12, 12', 12". In so doing, the elongate beam 60 provides integrity to the connection of the door panel 14 to the guide system 12, 12', 12". The elongate beam 60 also reduces damage to the overhead track and minimizes derailment of the door panels 14 from the overhead tracks.

Figure 17:
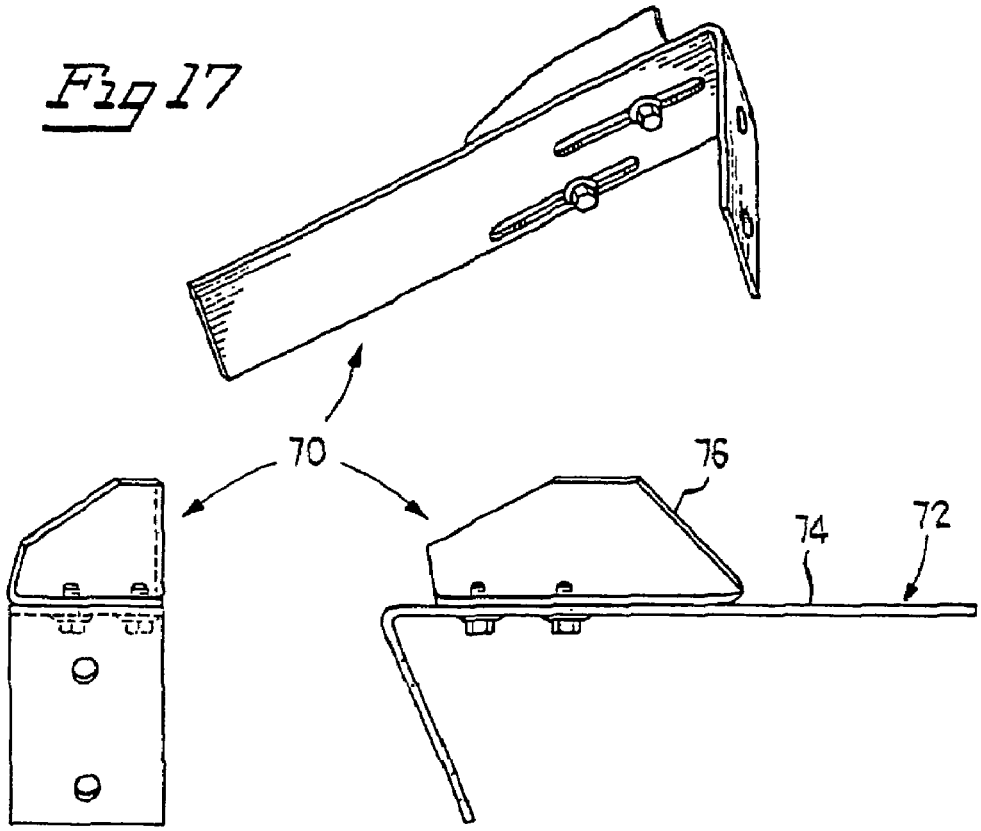
FIG. 17 includes perspective and side views of the reset member of the present invention; and, FIG. 18 includes perspective and side views of an alternative embodiment of the reset member of the present invention.
Figure 18:
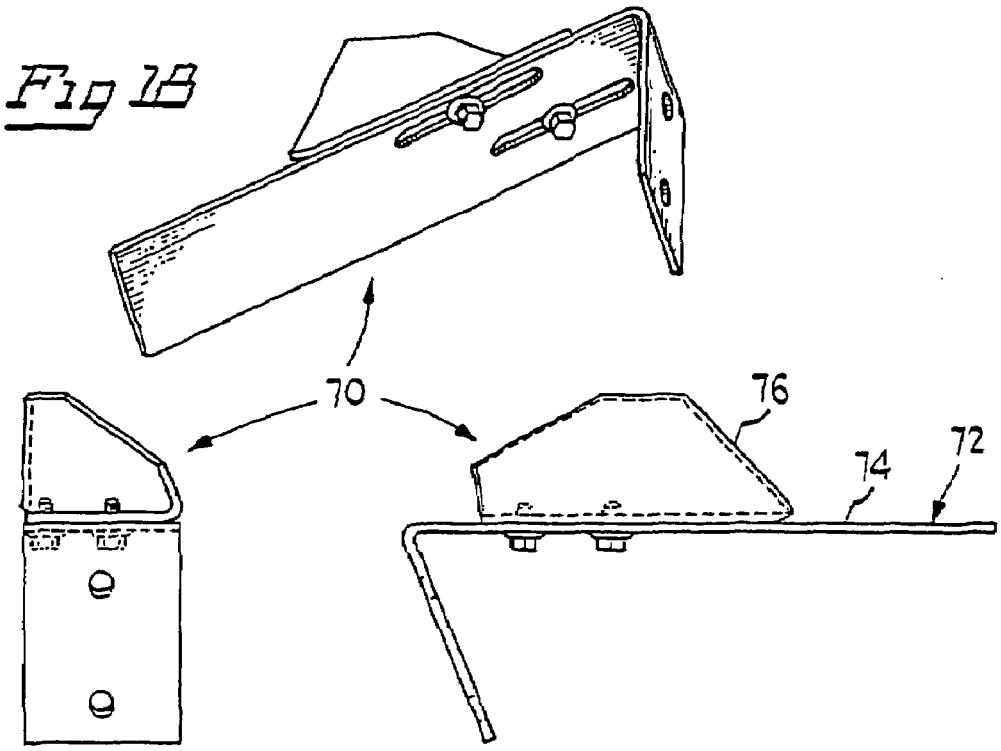

According to another embodiment of the present invention, the door system further comprises a reset member 70. As shown in FIGS. 15 and 16, the reset member 70 is disposed proximate the second end of the guide 22. The reset member 70 has a surface 72 that is angularly oriented to facilitate operable engagement and alignment of the guide follower 24 with the guide 22. In a preferred embodiment, the reset member is adapted for use on the left-hand and right-hand sides of the guide system 12. FIGS. 17 and 18 depict a left-hand and right-hand reset member 70, respectively. Each reset member 70 comprises a first ramp 74 and a second ramp 76. The first ramp 74 is canted upwardly from the plane of travel of the guide follower 24. The second ramp 76 angularly and upwardly depends from the surface 72 of the first ramp 74 and at least partially bisects the surface of the first ramp. Cooperation between the ramps 74, 76 of the reset member 70 and the guide system 12 facilitates operable engagement of the guide follower 24 and the guide 22.

While the specific embodiments have been illustrated and described, numerous modifications come to mind without significantly departing from the spirit of the invention and the scope of protection is only limited by the scope of the accompanying Claims.

What is claimed is:

1. A sliding door assembly for selectively limiting access to an opening having an upper and lower extent, the sliding door assembly including a door panel capable of being disengaged from the sliding door assembly upon receiving an impact in excess of a predetermined force to the sliding door assembly, the sliding door assembly comprising:

the door panel having a top, a bottom, a leading edge, and a trailing edge;

a guide including an opposing first and second end, the guide being mounted to a mounting surface proximate the opening and located between the upper and lower extent of the opening;

a guide follower attached to the door panel and removably engaged with the guide for guiding the door panel; wherein the guide follower is capable of being disengaged from the guide upon an impact in excess of a predetermined force to the door panel; and, a means for engaging the disengaged door panel with the guide after the impact.

2. The sliding door assembly of claim 1, wherein the means for engaging the disengaged door panel with the guide comprises:

a reset member disposed proximate the second end of the guide, the reset member having at least one angled surface to translate the guide follower into operative engagement and alignment of the guide follower with the guide.

3. The sliding door assembly of claim 2, wherein the means for engaging includes that the guide follower is pivotally attached to the door panel and pivotally biased around an axis parallel to the lateral translation of the door.

4. The sliding door assembly of claim 3, wherein the guide follower is biased by a torsion spring.

5. The sliding door assembly of claim 1, wherein the guide follower comprises:

a retention block having a first end and a second end, the retention block having a throughway disposed proximate the first end and along an axis parallel to the translational movement of the guide follower relative to the guide, wherein the throughway receives an elongate beam; and, a retention tab having a first end and a second end, the first end of the retention tab being connected proximate the second end of the retention block, the second end of the retention tab extending generally perpendicular to the retention block and having a channel proximate a distal end for slidably engaging the guide.

6. The sliding door assembly of claim 5, wherein at the second end of the retention tab is sufficiently flexible to permit the door panel to disengage from the guide upon receiving an impact in excess of a predetermined force.

7. The sliding door assembly of claim 1, wherein the means for engaging the door panel comprises a magnet on one of either the guide follower or the door panel and a magnet attracter on the other of the guide follower or the door panel.

8. A horizontally sliding door assembly for selectively limiting access to an opening having an upper and lower extent, the sliding door assembly comprising:

a door panel having a top, a bottom, a leading edge, and a trailing edge;

an electric motor for driving the door horizontally to open and close the opening;

a substantially horizontally disposed guide including an opposing first and second end, the guide being mounted to a mounting surface proximate the opening and being located between the upper and lower extent of the opening;

a guide follower connecting the door panel to the guide to assist the door panel in traveling horizontally; and, a means for permitting the door to disconnect from the guide upon an impact in excess of a predetermined force to the door panel without damage to the door panel or the guide.

9. The sliding door assembly of claim 8 wherein the means for permitting the sliding door to disconnect from the guide further comprises a means for the door to disconnect from the guide follower.

10. The sliding door assembly of claim 9 wherein the means for the door to disconnect from the guide follower comprises a magnet and magnetic attracter.

11. The sliding door assembly of claim 8 wherein the means for permitting the sliding door to disconnect from the guide further comprises a means for the guide follower to disconnect from guide.

12. The sliding door assembly of claim 11 wherein the guide follower further comprises a retention block and the means for the guide follower to disconnect from the guide comprises a flexible retention tab on the retention block.

13. The sliding door assembly of claim 8 wherein the means for permitting the sliding door to disconnect from the guide further comprises a means for a portion of the guide follower to disconnect from the guide.

14. The sliding door assembly of claim 8 further comprising a means for re-engaging the door panel with the guide after the impact in excess of the predetermined force.

* * * * *